US007934612B1

(12) United States Patent
Mullen

(10) Patent No.: US 7,934,612 B1
(45) Date of Patent: May 3, 2011

(54) BOTTLE NIPPLE SYSTEM

(76) Inventor: Miriam B. Mullen, St. Petersburg, FL (US)

( * ) Notice: Subject to any disclaimer, the term of this patent is extended or adjusted under 35 U.S.C. 154(b) by 248 days.

(21) Appl. No.: 11/983,915

(22) Filed: Nov. 13, 2007

(51) Int. Cl.
*A61J 9/00* (2006.01)

(52) U.S. Cl. ..... 215/11.1; 215/11.4; 215/11.5; 215/11.6

(58) Field of Classification Search ..... 215/11.1, 215/387, 388; 220/717; 119/71, 72
See application file for complete search history.

(56) References Cited

U.S. PATENT DOCUMENTS

| | | | | |
|---|---|---|---|---|
| 2,366,214 | A | 1/1945 | Ramaker | |
| 2,388,915 | A * | 11/1945 | Heilborn | 215/11.1 |
| 5,553,726 | A | 9/1996 | Park | |
| 5,606,871 | A * | 3/1997 | Hansen et al. | 62/457.5 |
| 5,711,759 | A * | 1/1998 | Smith et al. | 601/139 |
| 6,041,950 | A * | 3/2000 | Soehnlein | 215/11.1 |
| 6,123,210 | A * | 9/2000 | Kim | 215/11.6 |
| 6,161,710 | A * | 12/2000 | Dieringer et al. | 215/11.4 |
| 6,241,110 | B1 * | 6/2001 | Hakim | 215/11.1 |
| D457,640 | S * | 5/2002 | Alexandre | D24/194 |
| 6,994,225 | B2 * | 2/2006 | Hakim | 215/11.4 |
| 7,134,564 | B2 * | 11/2006 | Verbovszky | 215/11.4 |
| 2003/0236556 | A1 * | 12/2003 | Dickerson | 606/235 |
| 2005/0035078 | A1 * | 2/2005 | Lieberman et al. | 215/11.1 |
| 2005/0082301 | A1 * | 4/2005 | Verbovszky | 220/717 |
| 2009/0005810 | A1 * | 1/2009 | Bonazza | 606/235 |

* cited by examiner

*Primary Examiner* — Anthony Stashick
*Assistant Examiner* — Cynthia F Collado

(57) ABSTRACT

A bottle has a closed bottom, an open top and a peripheral cylindrical side wall. A nipple has a lower section in the shape of a truncated hemisphere, an intermediate section in the shape of a cylindrical, and an upper section in the shape of a hemisphere. The nipple has a hole, an interior surface and an exterior surface. The exterior surface includes a plurality of spaced hemispherically shaped projections including a plurality lower projections on the lower portion, a plurality of upper projections on the upper portion, and a plurality of intermediate projections on the intermediate portion. An adaptor removably couples the nipple to the bottle.

1 Claim, 2 Drawing Sheets

BOTTLE NIPPLE SYSTEM

BACKGROUND OF THE INVENTION

1. Field of the Invention

The present invention relates to a bottle nipple system and more particularly pertains to promoting the nourishment of an infant in a safe, convenient and economical manner.

2. Description of the Prior Art

The use of infant feeding systems of known designs and configurations is known in the prior art. More specifically, infant feeding systems of known designs and configurations previously devised and utilized for the purpose of feeding infants through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,388,915 issued Nov. 13, 1945 to Heilborn relates to a Nursing Nipple. U.S. Pat. No. 2,366,214 issued Jan. 2, 1945 to Ramaker relates to a Corrective Nipple for Nursing Bottles. U.S. Pat. No. 5,553,726 issued Sep. 10, 1996 to Park relates to a Dripless Feeder Nipple System with Detachable Valve. U.S. Pat. No. 6,041,950 issued Mar. 28, 2000 to Soehnlein relates to a Method and Apparatus for Weaning an Infant. Lastly, U.S. Pat. No. 6,241,110 issued Jun. 5, 2001 to Hakin relates to Baby Products and Methods of Manufacture.

While these devices fulfill their respective, particular objectives and requirements, the aforementioned patents do not describe a bottle nipple system that allows for promoting the nourishment of an infant in a safe, convenient and economical manner.

In this respect, the bottle nipple system according to the present invention substantially departs from the conventional concepts and designs of the prior art, and in doing so provides an apparatus primarily developed for the purpose of promoting the nourishment of an infant in a safe, convenient and economical manner.

Therefore, it can be appreciated that there exists a continuing need for a new and improved bottle nipple system which can be used for promoting the nourishment of an infant in a safe, convenient and economical manner. In this regard, the present invention substantially fulfills this need.

SUMMARY OF THE INVENTION

In view of the foregoing disadvantages inherent in the known types of infant feeding systems of known designs and configurations now present in the prior art, the present invention provides an improved bottle nipple system. As such, the general purpose of the present invention, which will be described subsequently in greater detail, is to provide a new and improved bottle nipple system and method which has all the advantages of the prior art and none of the disadvantages.

To attain this, the present invention essentially comprises a bottle nipple system. First provided is a bottle. The bottle has a closed bottom. The bottle has an open top. The bottle has a peripheral cylindrical side. The peripheral cylindrical side is provided between the top and the bottom. The bottle is adapted to receive a nourishing liquid. The nourishing liquid is to be consumed by an infant. The top of the bottle is adapted to removably receive and support a nipple. The bottle is fabricated of a liquid impervious material. The liquid impervious material is selected from the class of liquid impervious materials. The class of liquid impervious materials includes plastic and glass.

A nipple is provided. The nipple has a lower section. The lower section of the nipple is in the shape of a truncated hemisphere. The lower section of the nipple has a circular larger bottom. The lower section of the nipple has a circular smaller top. The nipple has an upper section. The upper section of the nipple is in the shape of a hemisphere. The upper section of the nipple has a circular bottom. The upper section of the nipple has a top. The top of the upper section of the nipple is formed with a hole. The hole provides for the passage of a liquid. The nipple has an intermediate section. The intermediate section of the nipple is in the shape of a cylinder. The intermediate section of the nipple has a circular bottom. The bottom of the intermediate section of the nipple is integrally formed with the top of the lower section of the nipple. The intermediate section of the nipple has a circular top. The top of the intermediate section of the nipple is integrally formed with the bottom of the upper section of the nipple. The nipple also has an radial projection. The radial projection is provided at the lowermost extent of the nipple.

The nipple is fabricated of an elastomeric material. The elastomeric material has flexibility and resilience. The elastomeric material is selected from the class of elastomeric materials with flexibility and resilience. The class of elastomeric materials with flexibility and resilience includes plastic and rubber, natural and synthetic, and blends thereof. The nipple has an interior surface. The nipple has an exterior surface. The exterior surface of the nipple has a plurality of spaced hemispherically shaped projections. The projections include a plurality of rings of lower projections. The rings of lower projections are provided on the lower portion. The projections include a plurality of upper projections. The upper projections are provided on the upper portion. The projections further include a plurality of rings of intermediate projections. The rings of intermediate projections are provided on the intermediate portion. All of the projections have a common radius. The common radius is equal to the thickness of the nipple remote from the projections, plus or minus 20 percent. The majority of the projections are spaced from the next adjacent projection by a distance. The distance is between 100 and 300 percent of the radius of the projections. The interior surface is smooth throughout its entire extent. In this manner the overall flexibility and resilience of the nipple is minimized.

Further provided is an adaptor. The adaptor has an open bottom. The adaptor has an apertured top. The adaptor has a peripheral cylindrical side wall. The side wall is provided between the top and the bottom. The bottom of the adaptor is adapted to removably couple with the top of the bottle. The top of the adaptor is adapted to removably couple with the nipple. In this manner the system is adapted to be tipped for feeding an infant. The lower projections are adapted to simultaneously contact and stimulate a face of a feeding infant. The intermediate projections are adapted to simultaneously contact and stimulate lips of a feeding infant. Finally, the upper projections are adapted to simultaneously contact and stimulate a tongue of a feeding infant.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bottle nipple system which has all of the advantages of the prior art infant feeding systems of known designs and configurations and none of the disadvantages.

It is another object of the present invention to provide a new and improved bottle nipple system which may be easily and efficiently manufactured and marketed.

It is further object of the present invention to provide a new and improved bottle nipple system which is of durable and reliable constructions.

An even further object of the present invention is to provide a new and improved bottle nipple system which is susceptible of a low cost of manufacture with regard to both materials and labor, and which accordingly is then susceptible of low prices of sale to the consuming public, thereby making such bottle nipple system economically available to the buying public.

Even still another object of the present invention is to provide a bottle nipple system for promoting the nourishment of an infant in a safe, convenient and economical manner.

Lastly, it is an object of the present invention to provide a new and improved bottle nipple system having a bottle has a closed bottom, an open top and a peripheral cylindrical side wall. A nipple has a lower section in the shape of a truncated hemisphere, an intermediate section in the shape of a cylindrical, and an upper section in the shape of a hemisphere. The nipple has a hole, an interior surface and an exterior surface. The exterior surface includes a plurality of spaced hemispherically shaped projections including a plurality lower projections on the lower portion, a plurality of upper projections on the upper portion, and a plurality of intermediate projections on the intermediate portion. An adaptor removably couples the nipple to the bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
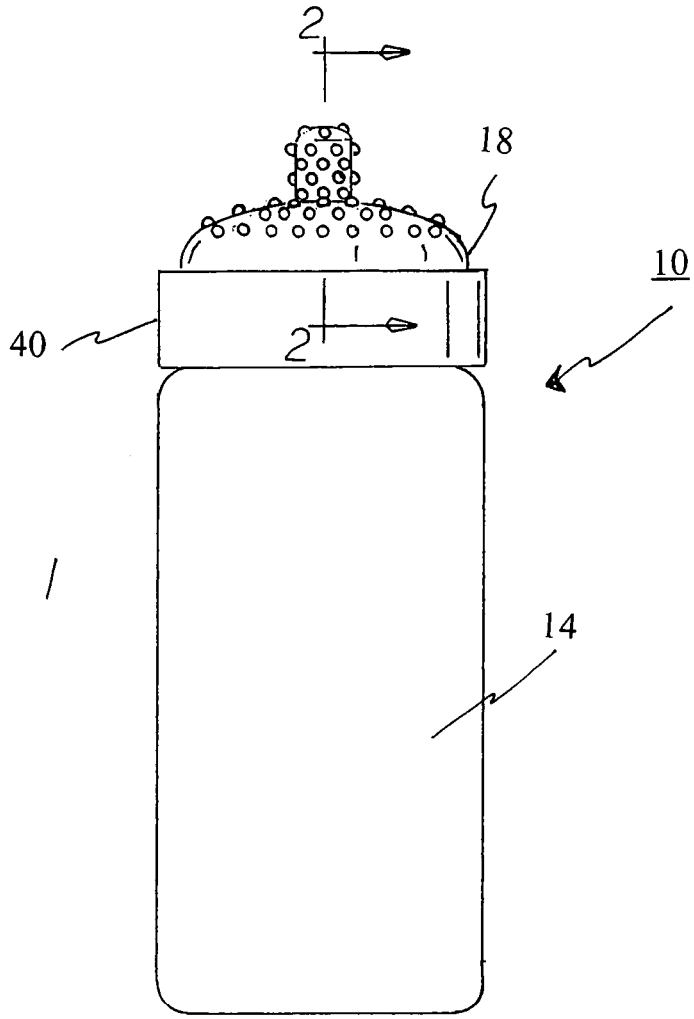
FIG. 1 is a front elevational view of a bottle nipple system constricted in accordance with the principles of the present invention.
Figure 2:
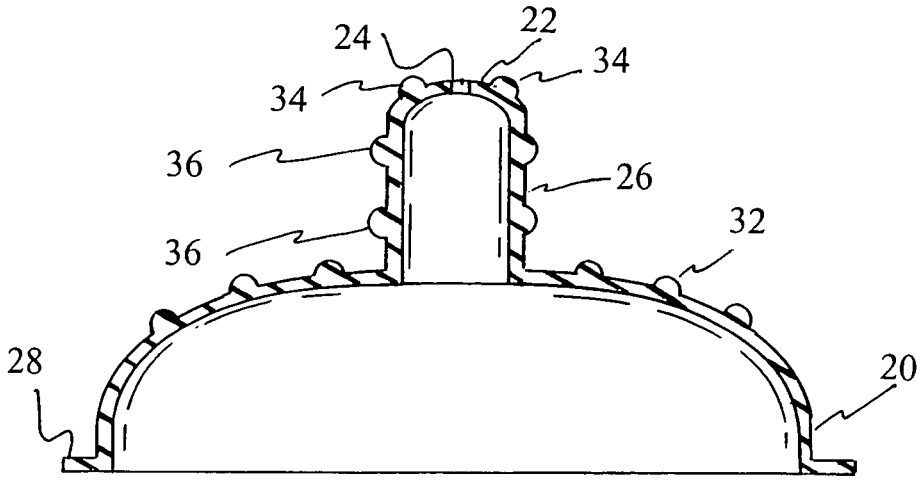
FIG. 2 is a cross sectional view taken along line 2-2 of FIG. 1.

With reference now to the drawings, and in particular to FIG. 1 thereof, the preferred embodiment of the new and improved bottle nipple system embodying the principles and concepts of the present invention and generally designated by the reference numeral 10 will be described.

The present invention, the bottle nipple system 10 is comprised of a plurality of components. Such components in their broadest context include a bottle, a nipple and an adaptor. Such components are individually configured and correlated with respect to each other so as to attain the desired objective.

First provided is a bottle 14. The bottle has a closed bottom. The bottle has an open top. The bottle has a peripheral cylindrical side. The peripheral cylindrical side is provided between the top and the bottom. The bottle is adapted to receive a nourishing liquid. The nourishing liquid is to be consumed by an infant. The top of the bottle is adapted to removably receive and support a nipple. The bottle is fabricated of a liquid impervious material. The liquid impervious material is selected from the class of liquid impervious materials. The class of liquid impervious materials includes plastic and glass.

A nipple 18 is provided. The nipple has a lower section 20. The lower section of the nipple is in the shape of a truncated hemisphere. The lower section of the nipple has a circular larger bottom. The lower section of the nipple has a circular smaller top. The nipple has an upper section 22. The upper section of the nipple is in the shape of a hemisphere. The upper section of the nipple has a circular bottom. The upper section of the nipple has a top. The top of the upper section of the nipple is formed with a hole 24. The hole provides for the passage of a liquid. The nipple has an intermediate section 26. The intermediate section of the nipple is in the shape of a cylinder. The intermediate section of the nipple has a circular bottom. The bottom of the intermediate section of the nipple is integrally formed with the top of the lower section of the nipple. The intermediate section of the nipple has a circular top. The top of the intermediate section of the nipple is integrally formed with the bottom of the upper section of the nipple. The nipple also has an radial projection 28. The radial projection is provided at the lowermost extent of the nipple.

The nipple is fabricated of an elastomeric material. The elastomeric material has flexibility and resilience. The elastomeric material is selected from the class of elastomeric materials with flexibility and resilience. The class of elastomeric materials with flexibility and resilience includes plastic and rubber, natural and synthetic, and blends thereof. The nipple has an interior surface. The nipple has an exterior surface. The exterior surface of the nipple has a plurality of spaced hemispherically shaped projections. The projections include a plurality of rings of lower projections 32. The rings of lower projections are provided on the lower portion. The projections include a plurality of upper projections 34. The upper projections are provided on the upper portion. The projections further include a plurality of rings of intermediate projections 36. The rings of intermediate projections are provided on the intermediate portion. All of the projections have a common radius. The common radius is equal to the thickness of the nipple remote from the projections, plus or minus 20 percent. The majority of the projections are spaced from the next adjacent projection by a distance. The distance is between 100 and 300 percent of the radius of the projections. The interior surface is smooth throughout its entire extent. In this manner the overall flexibility and resilience of the nipple is minimized.

Further provided is an adaptor 40. The adaptor has an open bottom. The adaptor has an apertured top. The adaptor has a peripheral cylindrical side wall. The side wall is provided between the top and the bottom. The bottom of the adaptor is adapted to removably couple with the top of the bottle. The top of the adaptor is adapted to removably couple with the nipple. In this manner the system is adapted to be tipped for feeding an infant. The lower projections are adapted to simultaneously contact and stimulate a face of a feeding infant. The intermediate projections are adapted to simultaneously contact and stimulate lips of a feeding infant. Finally, the upper projections are adapted to simultaneously contact and stimulate a tongue of a feeding infant.

Figure 3:
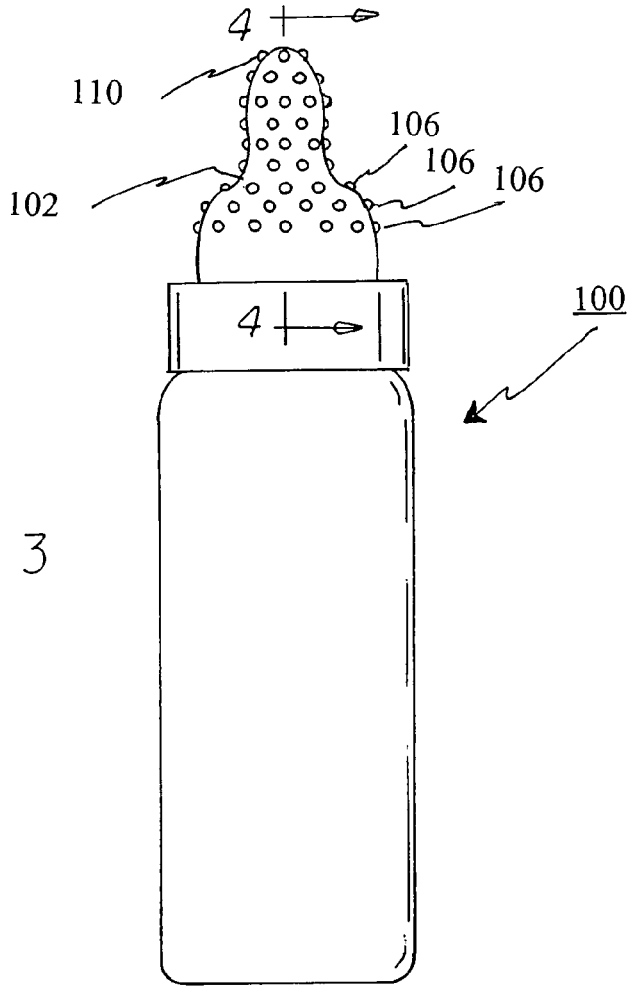
FIG. 3 is a front elevational view of a bottle nipple system constricted in accordance with an alternate embodiment of the present invention.
Figure 4:
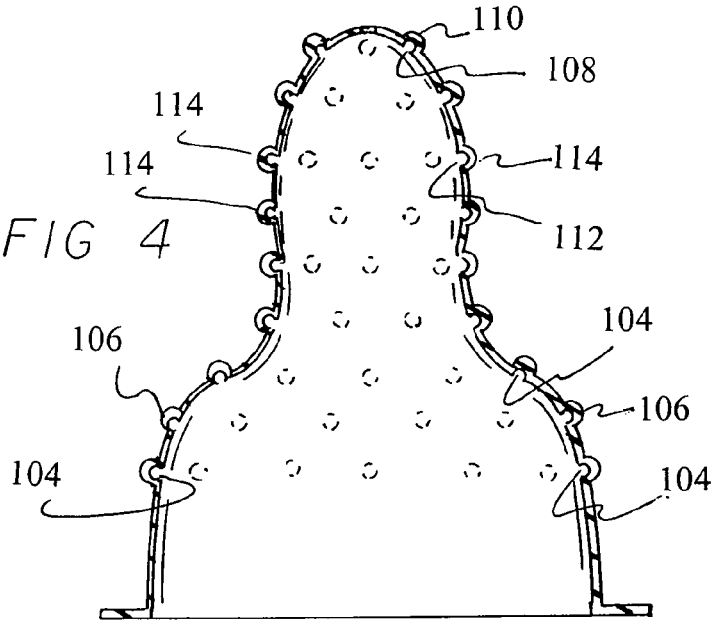
FIG. 4 is a cross sectional view taken along line 4-4 of FIG. 3.

Note FIGS. 3 and 4 which illustrates a system 100 which is an alternate embodiment of the invention. A nipple 102 is provided. The nipples has an interior surface. The interior surface is not smooth throughout its entire extent. The interior surface has lower recesses 104 and lower projections 106. The lower recesses are provided within the lower projections. The interior surface has upper recesses 108 and upper projections 110. The upper recesses are provided within the upper projections. The interior surface has intermediate recesses 112 and intermediate projections 114. The intermediate recesses are provided within the intermediate projections. In this manner a common thickness is provided throughout the entire extent of the nipple. Further in this manner the overall flexibility and resilience of the nipple is minimized.

During the teething stage of a baby is when often we start to se common colds, ear infections, conjunctivitis, etc. and excessive crying due to discomfort. The present invention ats to prevent and minimize baby from grabbing objects with bacteria or simply suing his/her own hands in the mouth. The present invention with sterilization can do the same soothing and at the same time nourish. The predental soothing nipple of the present invention is designed to pacify teething babies to sooth pain, discomfort and still let the baby keep both hydration and nurturing. Both nourishing and comfort can be provided in this early stage of a child's life as well as peace of mind to the mother.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bottle nipple system for promoting the nourishment of an infant in safe, convenient and economical manner comprising, in combination:

a bottle with a closed bottom and an open top with a peripheral cylindrical side between the top and the bottom, the bottle adapted to receive a nourishing liquid to be consumed by an infant, the top of the bottle adapted to removably receive and support a nipple, the bottle being fabricated of a liquid impervious material selected from the class of liquid impervious materials including plastic and glass;

a nipple having a lower section in the shape of a truncated hemisphere with a circular larger bottom and a circular smaller top, the nipple having an upper section in the shape of a hemisphere with a circular bottom and a top formed with a hole for the passage of a liquid, the nipple having an intermediate section in the shape of a cylinder with a circular bottom integrally formed with the top of the lower section and a circular top integrally formed with the bottom of the upper section, the nipple also being formed with an radial projection at its lowermost extent;

a common central axis extending through the truncated hemispherical lower section and the cylindrical intermediate section and the hemispherical upper section, the central axis having an upper portion within the upper section and an intermediate portion within the intermediate section with the intermediate section of the central axis being greater in length than the upper section of the central axis;

the nipple being fabricated of an elastomeric material with flexibility and resilience selected from the class of elastomeric materials with flexibility and resilience including plastic and rubber, natural and synthetic, and blends thereof, the nipple having an interior surface and an exterior surface which includes a plurality of spaced hemispherically shaped projections, the projections including a plurality of rings of lower projections on the lower portion and a plurality of upper projections on the upper portion and a plurality of rings of intermediate projections on the intermediate portion, all of the projections having a radii of equal length, the length equal to the thickness of, the nipple remote from the projections plus or minus 20 percent, the majority of the projections being spaced from the next adjacent projection by a distance between 100 and 300 percent of the radius of the projections, the interior surface being smooth throughout its entire extent thereby minimizing the overall flexibility and resilience of the nipple; and an adaptor with an open bottom and an apertured top with a peripheral cylindrical side wall between the top and the bottom, the bottom of the adaptor adapted to removably couple with the top of the bottle, the top of the adaptor adapted to removably couple with the nipple, whereby the system is adapted to be tipped for feeding an infant with the lower projections adapted to simultaneously contact and stimulate a face of a feeding infant, and with the intermediate projections adapted to simultaneously contact and stimulate lips of a feeding infant, and with the upper projections adapted to simultaneously contact and stimulate a tongue of a feeding infant.

* * * * *